US006750619B2

(12) United States Patent
Nemirow et al.

(10) Patent No.: US 6,750,619 B2
(45) Date of Patent: Jun. 15, 2004

(54) ELECTRONIC BALLAST WITH FILAMENT DETECTION

(75) Inventors: Arthur T. Nemirow, Carson City, NV (US); Storm S. Sears, Dayton, NV (US)

(73) Assignee: Bruce Industries, Inc., Dayton, NV (US)

( * ) Notice: Subject to any disclaimer, the term of this patent is extended or adjusted under 35 U.S.C. 154(b) by 0 days.

(21) Appl. No.: 10/265,350

(22) Filed: Oct. 4, 2002

(65) Prior Publication Data

US 2004/0066152 A1 Apr. 8, 2004

(51) Int. Cl.[7] ..... H05B 37/02

(52) U.S. Cl. ..... 315/291; 315/307; 315/107; 315/257; 315/224

(58) Field of Search ..... 315/307, 291, 315/94, 107, 106, 115, 116, 224, 257, 225

(56) References Cited

U.S. PATENT DOCUMENTS

| | | | | |
|---|---|---|---|---|
| 4,668,946 A | | 5/1987 | Volk et al. | 315/82 |
| 4,870,529 A | | 9/1989 | Powell et al. | 315/409 |
| 4,949,013 A | | 8/1990 | Zuchtriegel | 315/225 |
| 5,574,335 A | | 11/1996 | Sun | 315/307 |
| 5,612,595 A | * | 3/1997 | Maheshwari | 315/291 |
| 5,703,441 A | | 12/1997 | Steigerwald et al. | 315/307 |
| 5,729,096 A | | 3/1998 | Liu et al. | 315/225 |
| 5,869,935 A | | 2/1999 | Sodhi | 315/225 |
| 5,952,832 A | | 9/1999 | Stevanovic et al. | 315/107 |
| 6,140,771 A | | 10/2000 | Luger et al. | 315/307 |
| 6,175,189 B1 | | 1/2001 | Brooks | 315/119 |
| 6,243,017 B1 | * | 6/2001 | Kuisma | 340/641 |
| 6,339,299 B1 | * | 1/2002 | Wu et al. | 315/224 |
| 6,348,769 B1 | * | 2/2002 | Pinchuk et al. | 315/307 |
| 6,366,032 B1 | * | 4/2002 | Allison et al. | 315/307 |

OTHER PUBLICATIONS

Billings, Keith; Switchmode Power Supply Handbook; 1999; pp. 3.176–3.192; McGraw–Hill.

* cited by examiner

*Primary Examiner*—James Clinger
*Assistant Examiner*—Ephrem Alemu
(74) *Attorney, Agent, or Firm*—Brooks Kushman P.C.

(57) ABSTRACT

A fluorescent lamp electronic ballast for use with fluorescent lamps of the preheat or heated filament type is provided. The electronic ballast includes a multiple output DC to DC converter with a primary winding and a plurality of secondary windings for connecting to a plurality of lamp filaments. Each secondary winding is connected to a lamp filament through a diode/capacitor combination with a current transformer primary located in a high frequency loop. A sensing circuit is connected to a current transformer secondary. A controller is connected to the sensing circuit and controls the filament power supply. Advantages include the ability to predict lamp end of life, detect disconnected filaments and other problems that appear as an open circuit such as loose or misinstalled lamps and prevent arcing, detect smoldering of a heavily carbonized lamp holder, or detect short circuits.

23 Claims, 4 Drawing Sheets

ELECTRONIC BALLAST WITH FILAMENT DETECTION

BACKGROUND OF THE INVENTION

1. Field of the Invention

The present invention relates to fluorescent lamps of the preheat or heated filament type and to electronic ballasts of the type having a filament power supply including a multiple output DC to DC converter.

2. Background Art

The use of fluorescent lamps has become widespread. The typical fluorescent lamp is composed of a glass tube containing an inert gas and a small amount of mercury. Phosphors coat the inside of the glass tube, and each end of the glass tube includes an electrode. In operation, a ballast provides current to the electrodes. A traditional ballast is a special transformer that uses electromagnetic principles to generate operating and starting voltages for fluorescent lamps. An electronic ballast uses electronics to achieve the same result. In operation, electrons migrate across the length of the tube, and excite the mercury atoms which are in a gaseous state. The arc releases photons in the ultraviolet band. The photons excite the phosphors that coat the inside of the glass tube, and the phosphors emit visible light. Fluorescent lamps are very efficient during operation. Before a fluorescent lamp can operate as described above, the lamp must be started, that is, the length of tube must be made conductive. There are several existing techniques for starting a fluorescent lamp.

One technique for starting a fluorescent lamp involves the use of electrodes that include filaments. Each electrode is composed of two conductive pins that connect to a filament wire including tungsten and boron. Preheating the filament at each end of the fluorescent lamp tube boils electrons from the filament to ionize the gas inside the tube. The ionized gas inside the glass tube is conductive, and needs a voltage across the electrodes to establish an electrical arc. Using preheating techniques for the filaments increases lamp life, enhances dimming performance and enhances cold operation performance.

Another technique for starting a fluorescent lamp is known as instant start. In instant start fluorescent lamps, a very high initial voltage is applied across the electrodes which are typically single pin electrodes. The high voltage causes a corona discharge where the gas inside the glass tube is quickly ionized and an electrical arc is established. Although instant start is used in many fluorescent lamp applications, some fluorescent lamp applications demand that preheating techniques are utilized. Further, some applications continually heat the filaments even after establishing the electric arc.

Electronic ballasts have been used in fluorescent lamps of the preheat and heated filament type. The electronic ballasts typically include a filament power supply to provide filament heating power and to provide operating high voltage. Various approaches have been taken for providing the filament heating power.

One existing filament power supply for an electronic ballast uses a steel core transformer as a low frequency transformer to provide filament heating power. The transformer is physically large due to operation at 50 Hz, 60 Hz, or 400 Hz. Primary magnetizing losses and losses in the large turn windings make this approach electrically inefficient. In the event that a lamp filament is shorted, the short is reflected to the transformer primary side, thus shorting the ballast input. Recyclable thermal protection, thermal fuses or fuses are usually employed to prevent overheating of the ballast during this condition.

Another existing filament power supply for an electronic ballast uses a DC output flyback converter. The flyback converter topology reduces component count, and accommodates multiple outputs. The use of high frequency power conversion reduces the size and weight of the power transformer. The electrical efficiency is improved over the filament power supply using a steel core transformer.

Use of a high frequency switch mode converter to generate filament voltages has historically not been practical due to the circuit complexity and cost of such an approach. Recent advances in technology make this approach more viable. Accordingly, electronic ballasts of the type having a filament power supply including a DC output flyback converter are desirable for some preheat or heated filament type fluorescent lamp applications.

A particular problem faced in the fluorescent lamp industry is violent lamp end of life failure in certain applications caused by overheating of a broken or disconnected filament. Another particular problem faced in the fluorescent lamp industry is lamp to contact high voltage arcing caused by a loose or misinstalled lamp or an excessively worn lamp socket, and an excess voltage. Another particular problem faced in the fluorescent lamp industry is that heavily carbonized lamp holders may smolder during operation of the lamp.

To address these problems, some existing approaches detect when an arcing event is taking place and then shutdown the ballast high voltage constant current generator that generates the operating voltage. Such an approach, by design, requires that an arc occur so that it can be detected. Also, these approaches may fail to detect a smoldering lamp holder resulting in the lamp continuing to operate despite the potentially problematic situation. Background information relating to fluorescent lamps may be found in U.S. Pat. Nos. 4,668,946; 4,870,529; 4,949,013; 5,574,335; 5,703,441; 5,729,096; 5,869,935; 5,952,832; 6,140,771; and 6,175,189. Background information relating to current transformers may be found in Billings, Keith, *Switchmode Power Supply Handbook*, McGraw-Hill, 1999.

For the foregoing reasons, there is a need for an improved electronic ballast having a filament power supply including a DC converter for use with fluorescent lamps of the preheat or heated filament type that utilizes improved filament detection techniques suitable for detecting disconnected filaments, detecting other problems that appear as an open circuit such as loose or misinstalled lamps, or detecting the smoldering of a heavily carbonized lamp holder.

SUMMARY OF THE INVENTION

It is, therefore, an object of the present invention to provide a fluorescent lamp electronic ballast for use with fluorescent lamps of the preheat or heated filament type that utilizes a current transformer in a multiple output DC to DC converter.

In carrying out the above object, a fluorescent lamp electronic ballast for use with fluorescent lamps of the preheat or heated filament type is provided. The electronic ballast comprises a filament power supply, a sensing circuit, and a controller. The filament power supply includes a high voltage constant current generator for generating lamp operating voltages, and a multiple output DC to DC converter for providing filament heating power. The converter includes a primary winding and a plurality of secondary windings for connection to a plurality of lamp filaments. Each secondary winding is connected to a diode/capacitor combination to produce a DC voltage across the capacitor by action of the converter. This DC voltage is applied across each respective filament.

High frequency pulses of current are present in a loop composed of the secondary winding, diode and capacitor. These pulses of current are unidirectional due to the diode and action of the converter. A current transformer primary is inserted in any position in the high frequency loop. Switching the converter at high frequency allows the size of the current transformer to be minimized.

A secondary of the current transformer is connected to a diode that feeds a parallel combination of a resistor and a capacitor. The diode feeds the unidirectional secondary current into the resistor to produce a voltage analogous to current. The capacitor then peak charges this voltage to produce a DC voltage proportional to the RMS current of high frequency loop of the converter.

It is appreciated that the current measured with this technique is not exactly equivalent to the DC current flowing in the filament as some of the high frequency current is circulated through the capacitor that is in parallel with the filament. For this application the current measurement needs only to be proportional to the actual filament current.

It is appreciated that the sensing circuit may take any suitable form. For example, the high frequency loop current transformers may each have their own current transformer secondary winding connected to a peak detector, or the high frequency loop current transformers may share a single shared current transformer secondary winding connected to a peak detector. Individual current transformer secondary windings allow the sensing circuit to gather individual values that represent the high frequency loop current in each individual secondary winding of the converter. A single shared current transformer secondary winding allows the sensing circuit to gather a single value that represents the sum or total high frequency loop current of the secondary windings of the converter. Further, a single shared current transformer secondary winding may be used together with current transformer primary windings having varying numbers of turns with respect to each other such that is still possible for the sensing circuit or controller to determine individual values that represent the high frequency loop current in each individual secondary winding of the converter.

Further, it is to be appreciated that the controller may take any suitable form such as a microprocessor or microcontroller, or even discrete components arranged to provide the needed control. And further, the way that the controller is connected to the sensing circuit may take any suitable form, such as any number of individual inputs, multiplexed inputs, etcetera. It is appreciated that the structure of the filament power supply and location of the current transformers provides sensed signals that are indicative of the presence of open circuits in the filament circuits, that is, indicative of disconnected filaments, loose or misinstalled lamps, etcetera. Because the current transformers monitor filament current, the sensed signals may also be examined to detect the presence of short circuits or heavily carbonized lamp holders.

Preferably, the controller shuts down the high voltage generator when the high voltage generator is operating and the signals from the sensing circuit indicate an open circuit fault. Further, preferably, the controller prevents the operation of the high voltage generator when the high voltage generator is not operating and the signals from the sensing circuit indicate an open circuit fault.

In some embodiments, the controller controls the high voltage generator based on absolute measurements for filaments. That is, it is possible to compare values that represent the high frequency loop currents (including values that represent individual currents and values that represent sums of individual currents) to fixed reference values to determine filament status. These absolute comparisons are useful in many applications where the electronic ballast is designed for a specific lamp. The absolute measurements may be compared to either a fixed reference or a variable reference. On the other hand, it is possible to compare values (when there is more than one value) that represent the high frequency loop currents to each other to determine filament status. These relative comparisons are useful for universal ballasts that are not designed for any one specific lamp, and are also useful for detecting a smoldering condition due to a heavily carbonized lamp holder.

Further, in carrying out the present invention, a fluorescent lamp electronic ballast for use with single and dual fluorescent lamp configurations including fluorescent lamps of the preheat or heated filament type is provided. The electronic ballast comprises a filament power supply including a high voltage constant current generator for generating lamp operating voltages, and a multiple output DC to DC converter for providing filament heating power. The converter includes a primary winding and a plurality of secondary windings for connection to a plurality of lamp filaments include a first filament, second and third filaments connected in parallel, and a fourth filament. Each secondary winding is connected to a diode/capacitor combination to produce a DC voltage across the capacitor by action of the converter. This DC voltage is applied across each respective filament.

High frequency pulses of current are present in a loop composed of the secondary winding, diode and capacitor. These pulses of current are unidirectional due to the diode and action of the converter. A current transformer primary is inserted in any position in the high frequency loop. Switching the converter at high frequency allows the size of the current transformer to be minimized.

A secondary of the current transformer is connected to a diode that feeds a parallel combination of a resistor and a capacitor. The diode feeds the unidirectional secondary current into the resistor to produce a voltage analogous to current. The capacitor then peak charges this voltage to produce a DC voltage proportional to the RMS current of high frequency loop of the converter.

It is appreciated that the current measured with this technique is not exactly equivalent to the DC current flowing in the filament as some of the high frequency current is circulated through the capacitor that is in parallel with the filament. For this application the current measurement needs only to be proportional to the actual filament current.

Preferably, the controller shuts down the high voltage generator when the high voltage generator is operating and the signals from the sensing circuit indicate an open circuit fault. Further, preferably, the controller prevents the operation of the high voltage generator when the high voltage generator is not operating and the signals from the sensing circuit indicate an open circuit fault.

Preferably, the controller discriminates between single and dual fluorescent lamp configurations based on a signal from the sensing circuit corresponding to the second and third filaments.

Still further, in carrying out the present invention, a fluorescent lamp electronic ballast for use with single and dual fluorescent lamp configurations including fluorescent lamps of the preheat or heated filament type is provided. The electronic ballast includes a filament power supply including a high voltage constant current generator for generating lamp operating voltages, and a multiple output DC to DC converter for providing filament heating power. The converter includes a primary winding and a plurality of secondary windings for connection to a plurality of lamp filaments include a first filament, second and third filaments connected in parallel, and a fourth filament. Each secondary winding is connected to a diode/capacitor combination to produce a DC voltage across the capacitor by action of the converter. This DC voltage is applied across each respective filament.

High frequency pulses of current are present in a loop composed of the secondary winding, diode and capacitor. These pulses of current are unidirectional due to the diode and action of the converter. A current transformer primary is inserted in any position in the high frequency loop. Switching the converter at high frequency allows the size of the current transformer to be minimized.

A secondary of the current transformer is connected to a diode that feeds a parallel combination of a resistor and a capacitor. The diode feeds the unidirectional secondary current into the resistor to produce a voltage analogous to current. The capacitor then peak charges this voltage to produce a DC voltage proportional to the RMS current of high frequency loop of the converter.

It is appreciated that the current measured with this technique is not exactly equivalent to the DC current flowing in the filament as some of the high frequency current is circulated through the capacitor that is in parallel with the filament. For this application the current measurement needs only to be proportional to the actual filament current.

The controller is programmed to preheat the filaments, and to measure a sensing circuit signal corresponding to the second and third filaments. The controller discriminates between single and dual fluorescent lamp configurations based on the signal from the sensing circuit corresponding to the second and third filaments.

In a preferred embodiment, the controller is further programmed, in the dual lamp configuration, to measure a sensing circuit signal corresponding to the first filament, and measure a sensing circuit signal corresponding to the fourth filament. The controller determines a presence of an open circuit fault based on a comparison of a sum of the sensing circuit signals corresponding to the first and fourth filaments and the sensing circuit signal corresponding to the second and third filaments. The controller prevents operation of the high voltage generator in the presence of an open circuit fault.

In a preferred embodiment, the controller is further programmed, in the single lamp configuration, to measure a sensing circuit signal corresponding to the first filament, and measure a sensing circuit signal corresponding to the fourth filament. The controller determines a presence of an open circuit fault based on the sending circuit signals corresponding to the first and fourth filaments. The controller prevents operation of the high voltage generator in the presence of an open circuit fault.

In a preferred embodiment, the controller is further programmed to determine a presence of an open circuit fault based on a sum of the sensing circuit signals corresponding to the first and fourth filaments. The controller prevents operation of the high voltage generator in the presence of an open circuit fault.

The above object and other objects, features, and advantages of the present invention are readily apparent from the following detailed description of the preferred embodiments when taken in connection with the accompanying drawings.

DETAILED DESCRIPTION OF THE PREFERRED EMBODIMENT

Figure 1:
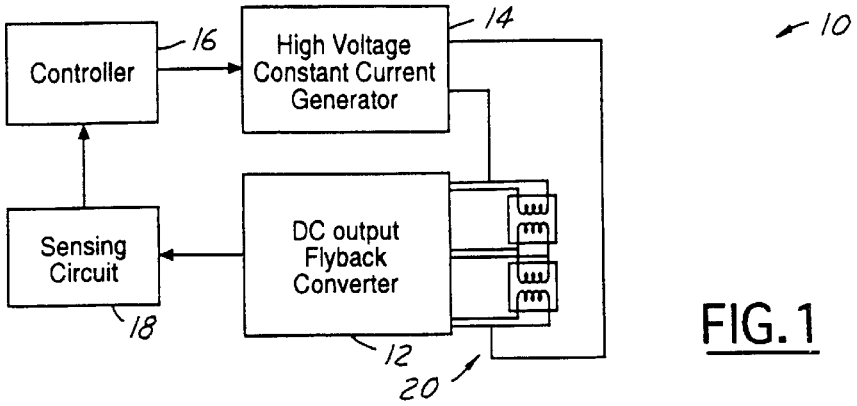
FIG. 1 illustrates a fluorescent lamp electronic ballast connected to fluorescent lamps in accordance with the present invention.
Figure 2:
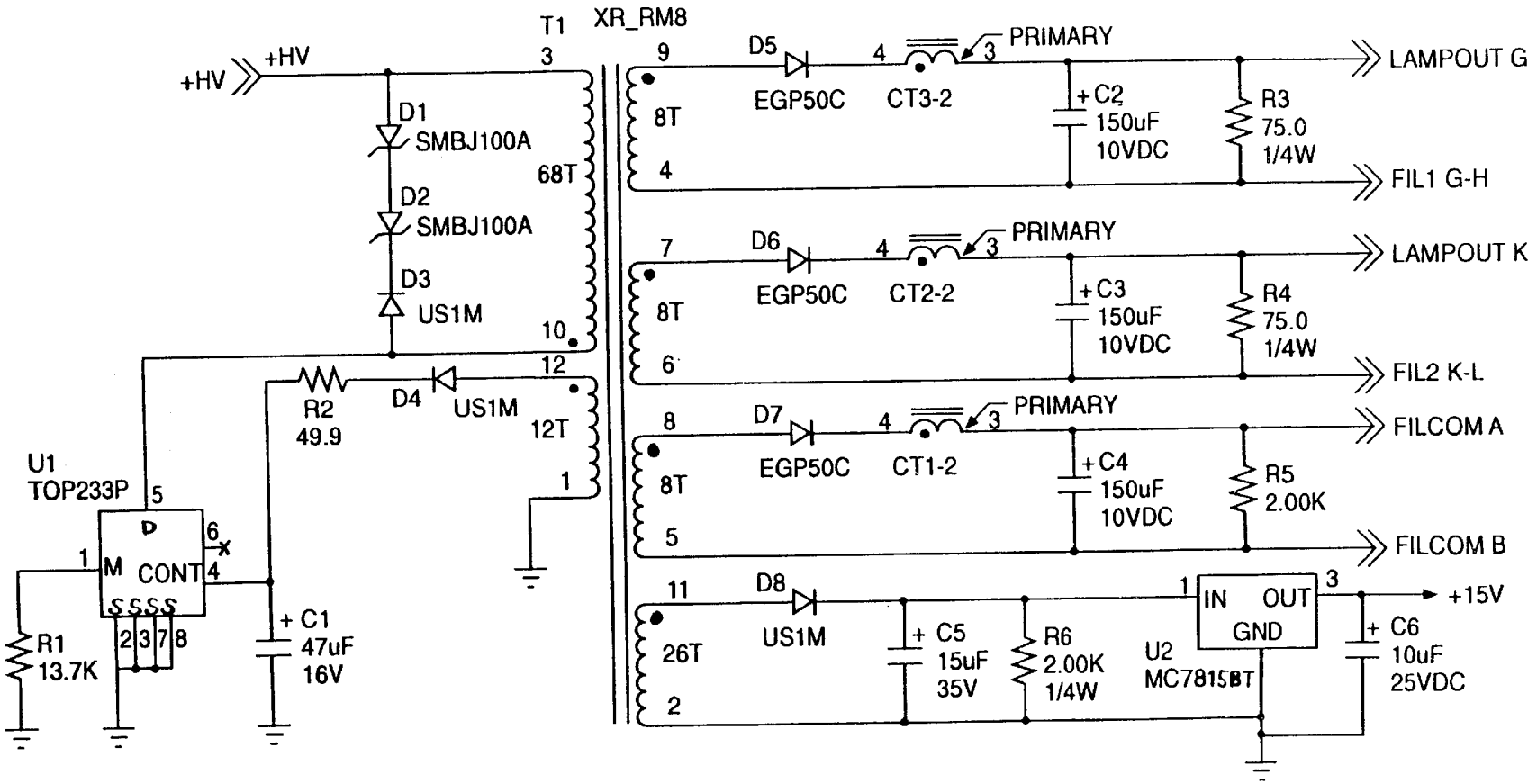
FIG. 2 illustrates an exemplary implementation of a DC output flyback converter filament supply.
Figure 3:
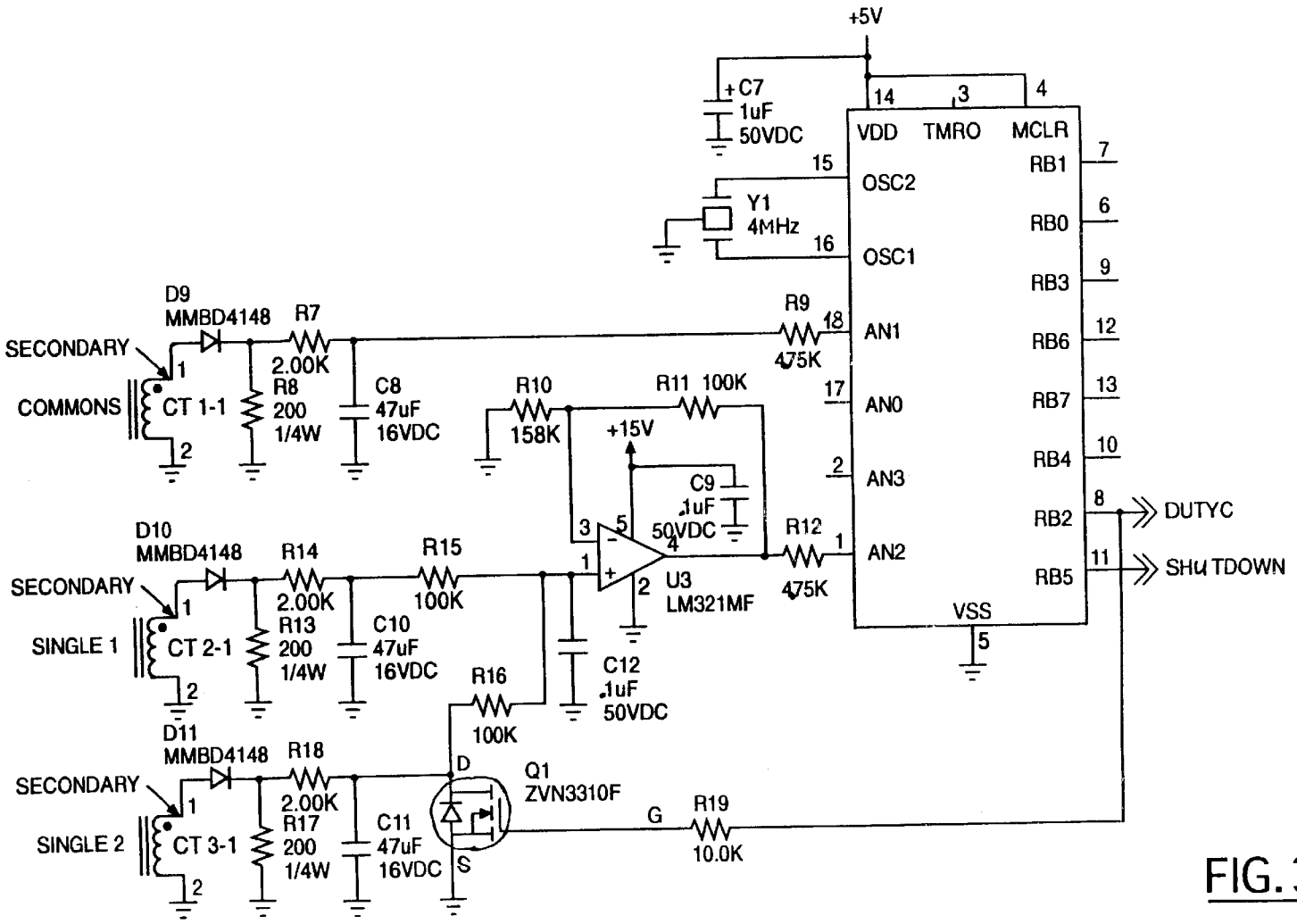
FIG. 3 illustrates an exemplary implementation of a sensing circuit and controller.
Figure 4:
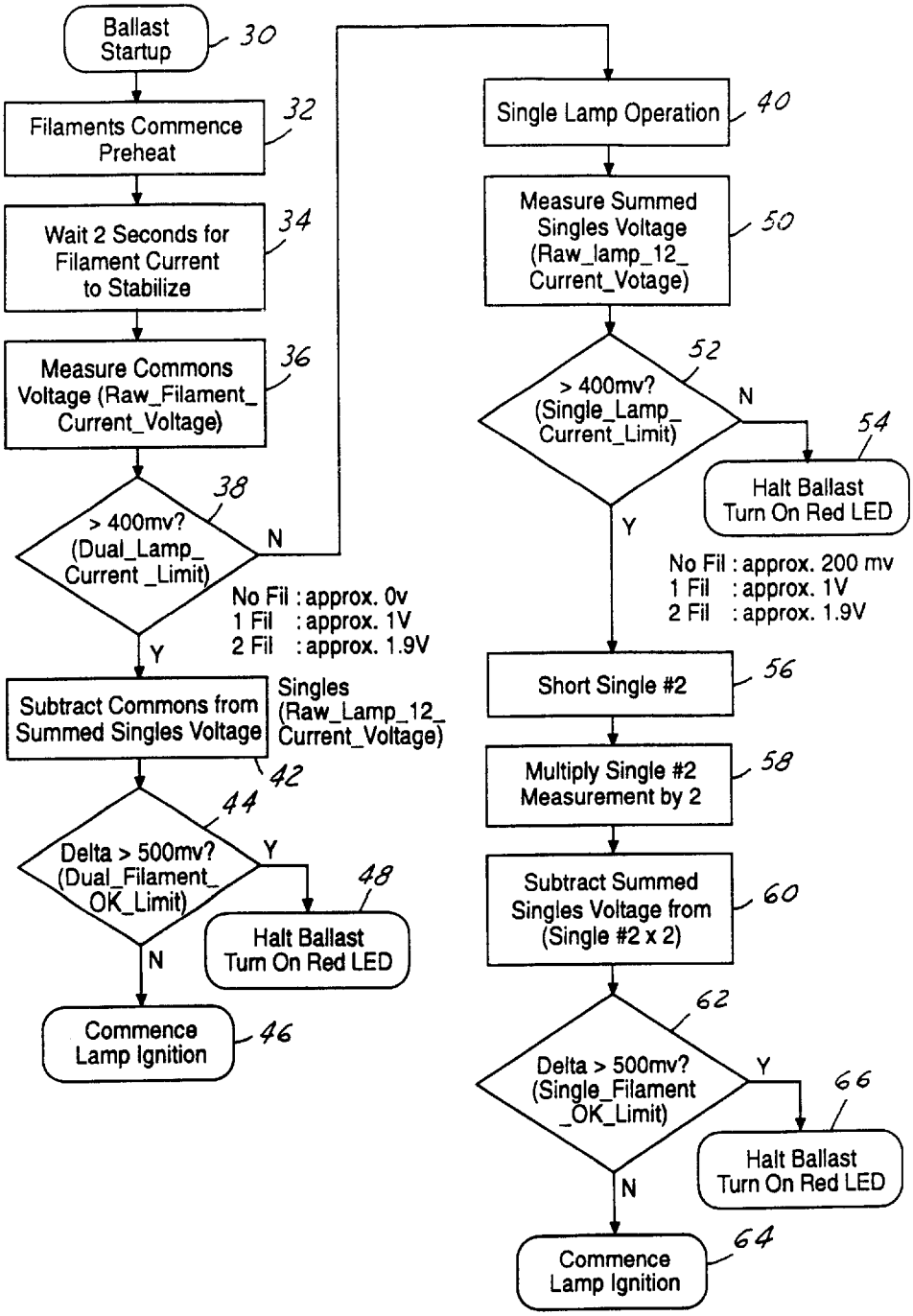
FIG. 4 illustrates an exemplary program flow for the controller using relative comparisons with the implementation of FIGS. 2 and 3.

FIG. 1 illustrates a fluorescent lamp electronic ballast connected to fluorescent lamps at 10. The ballast includes DC output flyback converter 12, high voltage constant current generator 14, and controller 16. Controller 16 controls the high voltage delivery during operation of the lamps. Sensing circuit 18 receives signals from current transformers connected to DC output flyback converter 12, which is a preferred form for the multiple output DC to DC converter, to detect open filament circuits or other detectable conditions that may occur due to a variety of different causes. An open circuit in a filament circuit causes a decrease in current through the respective current transformer, and a corresponding decrease in detected voltage at the sensing circuit 18. The controller 16 is programmed to, based on output from sensing circuit 18, use relative measurements to detect open filament circuits or other detectable conditions. Further, the controller is able to discriminate between single and dual lamp configurations. FIGS. 2–4 illustrate the exemplary embodiment in greater detail.

I. Hardware Description

A. DC Filament Supply (FIG. 2)

The DC filament supply is based on a flyback topology driven by a TOP233 Top Switch from Power Integrations. This circuit switches at a basic rate of 133 kHz, which is dithered slightly in frequency by the control IC to help mitigate the effects of conducted and radiated EMI. The control loop for the flyback is implemented using current feedback control via a secondary tap on the flyback transformer and components C1, R2, and D4.

The flyback transformer is wound on an RM8 bobbin which provides a very compact form factor. It was also found that the RM8 magnetic provided excellent performance repeatability from winding to winding, due to reduced leakage inductance effects.

There are three filament output circuits supplied by this configuration: two of the circuits are used to drive individual filaments either for single lamp operation or for driving the end filaments of a dual lamp configuration, the other output is used to drive the two common filaments encountered in a dual lamp configuration. In a single lamp configuration, the common filament output circuit is not used. Each of these filament drive circuits is isolated from one another and is also electrically isolated from both the ballast electrical ground and chassis ground. In this manner, low voltage componentry can be used to develop the DC filament drive potential even though these signals are later combined with the high voltage potential used to run the lamp. Load resistors R3, R4, and R5 were placed on the outputs of the filament circuits to prevent the output voltage from changing dramatically during an open circuit condition. This could potentially affect the output voltage of the other circuits and could also potentially damage the circuit. The output voltage of each of the three filament drive circuits is set nominally to 4 volts DC. An additional tap on the flyback transformer, referenced to the ballast ground, is used in conjunction with D8, C5, C6, R5, and regulator U2, to develop the necessary housekeeping voltage to run the ballast circuitry.

The current transformers employed in the arc prevention circuit have a ratio of 50 to 1. The single turn side of each of these three current transformers; CT1, CT2, and CT3, is placed respectively, in the high frequency path of each of the three filament drive circuits.

B. 3 Current Transformer Circuit with PIC Microcontroller (FIG. 3)

The 50 turn side of current transformer CT1, which is used to sense the current in the common filament drive circuit, is connected to components D9, R8, R7, and C8, which are used to peak detect the voltage developed by the current transformer and convert it to a usable DC level. With no lamps connected to the Commons filament circuit this voltage is approximately 0.0 volts DC. With a single filament connected to the Commons filament circuit this voltage is approximately 1 volt DC and finally, for two filaments connected to the Commons filament circuit, this voltage is approximately 2 volts DC. This voltage is fed into one of the analog input channels (AN1) of a PIC microcontroller, which is configured with an 8-bit A/D converter.

In a similar fashion, the 50 turn side of current transformers CT2 and CT3 are used in conjunction with D10, D11, R13, R14, R17, R18, C10 and C11, to develop voltages proportional to the current flowing in the two Singles filament circuits. These voltages are summed by amplifier U3 and fed to analog input AN2 on the PIC microcontroller. The gain of amplifier U3 is adjusted so that the sum of the output of the two single filament drive circuits is equivalent to the output of the Commons circuit with two filaments connected. Thus, with no filaments connected to either of the Singles filament drive circuits, the voltage fed to the PIC microcontroller is approximately 200 mV. With one filament connected, the voltage developed is approximately 1 volt DC, and for a two filament configuration, the voltage developed is approximately 2 volt DC.

In order to free up some of the input channels of the PIC microcontroller for other uses, a multiplexing scheme was used to allow the output of the two Singles filament drive circuits to be measured independently. FET Q3 is gated by DUTYC control signal from the PIC. When the FET is conducting, only the voltage, representative of the current flowing in one of the two Singles filament drive circuits, is being fed to the PIC microcontroller for measurement.

II. Software Algorithm (FIG. 4)

The software algorithm is based on a relative comparison of the voltages, representative of current in the filament circuits, developed by the three current transformer networks. By performing comparisons, it is possible to determine:

1. Whether the ballast is operating with a single or dual lamp load.

2. Whether the lamps in a single or dual lamp load are connected properly.

3. Whether the filaments in the lamp load are open, shorted, or excessively aged.

1. Startup Mode 0

Prior to lamp ignition, the program is in Startup Mode 0. After power is applied to the ballast, two seconds are allowed to elapse to allow the lamp filaments to heat up and stabilize (blocks 30, 32, 34). After this, the voltage developed by the Commons filament current transformer network is sampled at analog input AN1 of the PIC microcontroller and is stored as variable Raw_Filament_Current_Voltage (block 36). If this voltage is less than 400 mV, then it is determined that there is a single lamp load on the ballast and the program jumps to Startup Mode 0s (single lamp). If the dual lamp limit requirement has been met, then the voltage from the Commons filament current transformer network (input AN1) is subtracted from the sum of the two Singles filament current transformer networks being fed into analog input AN2 of the PIC microcontroller (blocks 38, 40, 42). The difference between these two inputs, or delta, is then compared to the Dual_Filament_OK _Limit (block 44). If the limit is not exeeded then lamp ignition will commence (block 46). If the limit is exceeded, then the ballast will latch off and indicate a lamp fault via an LED indicator (block 48).

2. Startup Mode 0s

If single lamp operation is determined, then the summed Singles filament voltage is compared to the Single_Lamp_Current_Limit (blocks 50, 52). If this limit of 400 mV is not exceeded, then it can be construed that no lamp at all is connected to the ballast and therefore, the ballast will halt operation (block 54). If the single lamp current limit is met, then a multiplexing scheme is used to compare the voltages generated by the two Singles filament current transformer networks (blocks 56, 58, 60). If the difference, or delta, between the two Singles voltage levels does not exceed the Single_Filament_OK_Limit, then lamp ignition will commence (blocks 62, 64). If this limit is exceeded, then the ballast will latch off and indicate a lamp fault via an LED indicator (block 66).

3. Normal Mode

Once lamp ignition has successfully occurred, then the program enters the Normal Mode of operation. In this mode, the voltages representative of the Commons filament circuit (analog input AN1) and the sum of the Singles filament circuits (analog input AN2) are monitored at a 10 msec interval. Any deviation in the averaged norm of these input voltages which exceeds the Open_Filament_Limit, starts a software fault timer, the timeout duration of which, is set by the parameter: Filament_Open_Time. If the voltage deviation in either the Commons or Singles filaments circuits persists for a period longer than that established by the Filament_Open_Time parameter, then the program will enter the Fault Mode and shut down the ballast.

In the unlikely event that an arcing condition should occur during ballast operation, then a secondary form of arc detection resides in the software to detect this condition. The PIC microcontroller also monitors the high voltage that is being supplied to the lamp load. This voltage is reduced via a voltage divider and is fed to analog input AN0 of the PIC microcontroller. During normal operation, this voltage is also monitored at a 10 msec interval. Any deviation from the averaged norm of this voltage which exceeds the Arc_Voltage_Limit parameter will start a software fault counter, the timeout duration of which is set by the parameter: Arc_Time_Limit. If the voltage deviation on the high voltage bus, indicative of an arcing event or lamp malfunction, persists beyond the period established by the Arc_Time_Limit parameter, then the program will enter the Fault Mode and shut down the ballast.

III. Sensing Circuits and Comparison Techniques (FIGS. 5–8)

Figure 5:
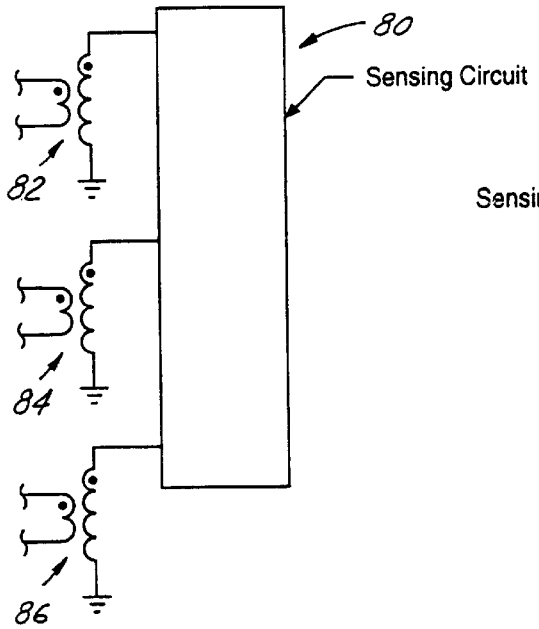
FIG. 5 illustrates the use of high frequency current loop transformers each having their own current transformer secondary winding.
Figure 6:
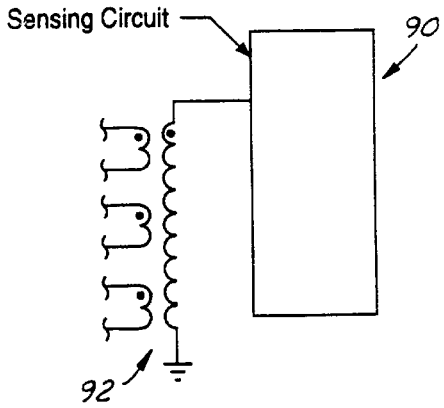
FIG. 6 illustrates the use of high frequency current loop transformers sharing a single shared current transformer secondary winding.

FIGS. 5–8 illustrate suitable sensing circuits and comparison techniques for various embodiments of the present invention. The high frequency loop current transformers may each have their own current transformer secondary winding connected as shown in FIG. 5 with sensing circuit 80 and current transformers 82, 84, 86. Or, the high frequency loop current transformers may share a single shared current transformer secondary winding as shown in FIG. 6 with sensing circuit 90 and three current transformer primary windings sharing a single secondary winding at 92. Individual current transformer secondary windings (FIG. 5) allow the sensing circuit to gather individual values that represent the high frequency loop current in each individual secondary winding of the converter. A single shared current transformer secondary winding (FIG. 6) allows the sensing circuit to gather a single value that represents the sum or total high frequency loop current of the secondary windings of the converter. Further, a single shared current transformer secondary winding (FIG. 6) may be used together with current transformer primary windings having varying numbers of turns with respect to each other such that is still possible for the sensing circuit controller to determine individual values that represent the high frequency loop current in each individual secondary winding of the converter.

The way that the controller is connected to the sensing circuit 80, 90 may take any suitable form, such as any number of individual inputs, multiplexed inputs, etcetera. It is appreciated that the structure of the filament power supply and location of the current transformers provides sensed signals that are indicative of the presence of open circuits in the filament circuits, that is, indicative of disconnected filaments, loose or misinstalled lamps, etcetera. Because the current transformers monitor filament current, the sensed signals may also be examined to detect the presence of short circuits or heavily carbonized lamp holders.

Figure 7:
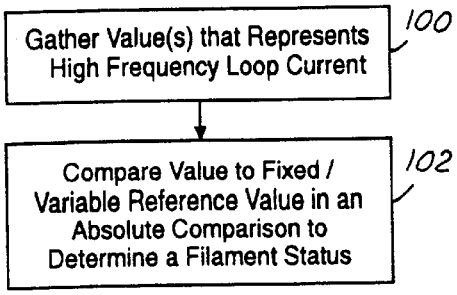
FIG. 7 illustrates the making of an absolute comparison of a measured value to a fixed reference value or a variable reference value.

As illustrated by FIG. 7, it is possible to compare values that represent the high frequency loop currents (including values that represent individual currents and values that represent sums of individual currents) to fixed or variable reference values to determine filament status by making an absolute comparison of a measured value to a reference value. At block 100, a value is gathered that represents a high frequency loop current. At block 102, the gathered value is compared to a fixed or variable reference value in an absolute comparison to determine filament status. These absolute comparisons are useful in many applications where the electronic ballast is designed for a specific lamp.

Figure 8:
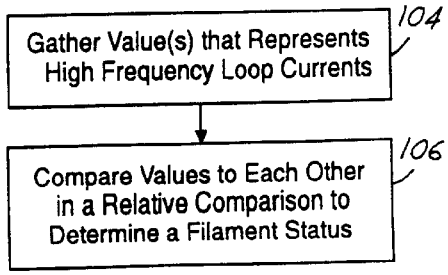
FIG. 8 illustrates the making of a relative comparison of one measured value to another measured value.

As illustrated by FIG. 8, it is possible to compare values (when there is more than one value) that represent the high frequency loop currents to each other to determine filament status. At block 104, values are gathered that represent high frequency loop currents. At block 106, the gathered values are compared to each other in a relative comparison to determine filament status. These relative comparisons are useful for universal ballasts that are not designed for any one specific lamp, and are also useful for detecting a smoldering condition due to a heavily carbonized lamp holder.

It is appreciated that as illustrated by FIGS. 5–8, values representing high frequency loop currents may be obtained in a number of ways. Those values may come from individual current transformer secondary windings (FIG. 5) or from shared current transformer secondary windings (FIG. 6) or combinations thereof. The values are used in comparisons to determine filament status and detect other conditions. Absolute comparisons to a fixed or variable reference are appropriate in some situations while relative comparisons between or among values are appropriate in other situations. The controller may be programmed in any appropriate way to make a number of comparisons and arrive at conclusions. One of ordinary skill in the art appreciates that any suitable controller algorithm may be used in embodiments of the present invention and that the exemplary algorithm uses individual current transformer windings and relative comparisons, but such an implementation is only exemplary. As such, it is appreciated the values may be obtained in any suitable way and the comparisons performed in any suitable way to determine filament status. Below, examples of fixed and variable reference absolute comparison systems that use the circuit of FIG. 6 are provided. Of course, each example system has advantages and disadvantages depending on the application.

In an example fixed reference system the software is as follows:

1. Power is applied to the ballast.
2. The microprocessor goes through an initialization sequence to set input/output configurations.
3. A start-up delay sequence is initiated to let the system stabilize.
4. The D/A converts the current sense voltage.
5. The value is compared against a high to low range for two lamp operation (four filament loads).
6. If the value is not in the four filament range it is compared to the range for one lamp operation (two filament loads).
7. A determination is made as to the lamp load either being a one lamp load or two lamp load else the ballast is latched off.
8. Once the lamp load configuration (one or two lamps) has been determined the voltage is monitored.
9. If the voltage changes so that two or four filaments is not indicated, the ballast is latched off, else go to step 8.

The one lamp vs. two lamp determination is only required for universal type ballasts. This fixed reference system detects if a lamp is misinstalled and latches the ballast off even before an attempt is made to strike the lamp(s). If the filaments become disconnected during operation the ballast latches off. This provides both arc protection and end of life protection.

In an example variable reference system the software is as follows:

1. Power is applied to the ballast.
2. The microprocessor goes through an initialization sequence to set input/output configurations.
3. A start-up delay sequence is initiated to let the system stabilize.
4. The D/A converts the current sense voltage.
5. The value is placed in a NEW VALUE register.
6. A time delay is inserted.

7. The value in NEW VALUE is moved into the OLD VALUE register.
8. The D/A converts the current sense voltage.
9. The value is placed in a NEW VALUE register.
10. NEW VALUE is compared to OLD VALUE.
11. If NEW VALUE is significantly different than OLD VALUE then the ballast latches off, else go to step 6.

This variable reference system eliminates the need for a one lamp/two lamp determination. The variation in filament resistance is not an issue as in the fixed reference system.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fluorescent lamp electronic ballast for use with fluorescent lamps of the preheat or heated filament type, the electronic ballast comprising:

a filament power supply including a high voltage constant current generator for generating lamp operating voltages, and a multiple output DC to DC converter for providing filament heating power, the converter including a primary winding and a plurality of secondary windings for connecting to a plurality of lamp filaments, each secondary winding being connected to a lamp filament through a diode/capacitor combination with a current transformer primary located in a high frequency loop composed of the secondary winding, the diode, and the capacitor:

a sensing circuit connected to a current transformer secondary; and a controller connected to the sensing circuit and controlling the filament power supply in response to signals from the sensing circuit.

2. The electronic ballast of claim 1 wherein the sensing circuit connects to each current transformer via an individual current transformer secondary winding.

3. The electronic ballast of claim 1 wherein the sensing circuit connects to the current transformers via a single shared current transformer secondary winding.

4. The electronic ballast of claim 1 wherein the controller shuts down the high voltage generator when the high voltage generator is operating and the signals from the sensing circuit indicate an open circuit fault.

5. The electronic ballast of claim 1 wherein the controller prevents the operation of the high voltage generator when the high voltage generator is not operating and the signals from the sensing circuit indicate an open circuit fault.

6. The electronic ballast of claim 1 wherein the controller controls the high voltage generator based on absolute measurements for filaments.

7. The electronic ballast of claim 6 wherein the absolute measurements are compared to a fixed reference by the controller.

8. The electronic ballast at claim 6 wherein the absolute measurements are compared to a variable reference by the controller.

9. The electronic ballast of claim 1 wherein the controller controls the high voltage generator based on relative measurements between filaments.

10. A fluorescent lamp electronic ballast for use with single and dual fluorescent lamp configurations including fluorescent lamps of the preheat or heated filament type, the electronic ballast comprising:

a filament power supply including a high voltage constant current generator for generating lamp operating voltages, and a multiple output DC to DC converter for providing filament heating power, the converter including a primary winding and three secondary windings for connecting to a plurality of lamp filaments including a first filament, second and third filaments connected in parallel, and a fourth filament, each secondary winding being connected to a lamp filament through a diode/capacitor combination with a current transformer primary located in a high frequency loop composed of the secondary winding, the diode, and the capacitor;

a sensing circuit connected to a current transformer secondary; and a controller connected to the sensing circuit and controlling the filament power supply in response to signals from the sensing circuit.

11. The electronic ballast of claim 10 wherein the sensing circuit connects to each current transformer via an individual current transformer secondary winding.

12. The electronic ballast of claim 10 wherein the sensing circuit connects to the current transformers via a single shared current transformer secondary winding.

13. The electronic ballast of claim 10 wherein the controller shuts down the high voltage generator when the high voltage generator is operating and the signals from the sensing circuit indicate an open circuit fault.

14. The electronic ballast of claim 10 wherein the controller prevents the operation of the high voltage generator when the high voltage generator is not operating and the signals from the sensing circuit indicate an open circuit fault.

15. The electronic ballast of claim 10 wherein the controller controls the high voltage generator based on absolute measurements for filaments.

16. The electronic ballast of claim 15 wherein the absolute measurements are compared to a fixed reference by the controller.

17. The electronic ballast at claim 16 wherein the absolute measurements are compared to a variable reference by the controller.

18. The electronic ballast of claim 10 wherein the controller controls the high voltage generator based on relative measurements between filaments.

19. The electronic ballast of claim 10 wherein the controller discriminates between single and dual fluorescent lamp configurations based on a signal from the sensing circuit corresponding to the second and third filaments.

20. A fluorescent lamp electronic ballast for use with single and dual fluorescent lamp configurations including fluorescent lamps of the preheat or heated filament type, the electronic ballast including a filament power supply including a high voltage constant current generator for generating lamp operating voltages, and a converter for providing filament heating power, the converter including a primary winding and three secondary windings for connecting to a plurality of lamp filaments including a first filament, second and third filaments connected in parallel, and a fourth filament, each secondary winding being connected to a lamp filament through a diode/capacitor combination with a current transformer primary located in a high frequency loop composed of the secondary winding, the diode, and the capacitor, the electronic ballast further including a sensing circuit connected to a current transformer secondary, and a controller connected to the sensing circuit and the filament power supply, the controller being programmed to:

preheat the filaments;

measure a sensing circuit signal corresponding to the second and third filaments; and discriminate between single and dual fluorescent lamp configurations based on the signal from the sensing circuit corresponding to the second and third filaments.

21. The electronic ballast of claim 20 wherein the controller is further programmed, in the dual lamp configuration, to:

measure a sensing circuit signal corresponding to the first filament;

measure a sensing circuit signal corresponding to the fourth filament;

determining a presence of an open circuit fault based on a comparison of a sum of the sensing circuit signals corresponding to the first and fourth filaments and the sensing circuit signal corresponding to the second and third filaments; and preventing operation of the high voltage generator in the presence of an open circuit fault.

22. The electronic ballast of claim 20 wherein the controller is further programmed, in the single lamp configuration, to:

measure a sensing circuit signal corresponding to the first filament;

measure a sensing circuit signal corresponding to the fourth filament;

determining a presence of an open circuit fault based on the sending circuit signals corresponding to the first and fourth filaments; and preventing operation of the high voltage generator in the presence of an open circuit fault.

23. The electronic ballast of claim 20 wherein the controller is further programmed to:

determine a presence of an open circuit fault based on a sum of the sensing circuit signals corresponding to the first and fourth filaments; and preventing operation of the high voltage generator in the presence of an open circuit fault.

* * * * *